US005411080A

United States Patent [19]

Gentry

[11] Patent Number: 5,411,080

[45] Date of Patent: May 2, 1995

[54] BAFFLE RINGS FOR RETROFIT OF EXISTING SHELL-AND-TUBE HEAT EXCHANGERS

[75] Inventor: Cecil C. Gentry, Bartlesville, Okla.

[73] Assignee: Phillips Petroleum Company, Bartlesville, Okla.

[21] Appl. No.: 175,019

[22] Filed: Dec. 29, 1993

[51] Int. Cl.[6] ..... F28F 9/00

[52] U.S. Cl. ..... 165/162; 122/510

[58] Field of Search ..... 165/159, 160, 161, 162; 122/510

[56] References Cited

U.S. PATENT DOCUMENTS

| | | | |
|---|---|---|---|
| 4,136,736 | 1/1979 | Small | 165/162 |
| 4,398,595 | 8/1983 | Small | 165/109 R |
| 4,793,406 | 12/1988 | Becker | 165/162 |
| 5,139,084 | 8/1992 | Gentry | 165/162 |
| 5,305,824 | 4/1994 | Gasseling | 165/47 |

FOREIGN PATENT DOCUMENTS

| | | | |
|---|---|---|---|
| 383992 | 8/1973 | U.S.S.R. | 165/162 |
| 939926 | 6/1982 | U.S.S.R. | 165/162 |

OTHER PUBLICATIONS

R. Perry and C. Chilton eds., *Chemical Engineers' Handbook*, McGraw-Hill, 5th ed., 1973, pp. 11-14.

C. C. Gentry, RODbaffle Heat Exchanger Technology, Chemical Engineering Progress, 86 (7), p. 54 (1990).

*Primary Examiner*—John Rivell
*Assistant Examiner*—L. R. Leo
*Attorney, Agent, or Firm*—Ryan N. Cross

[57] ABSTRACT

A baffle ring suitable for retrofitting an existing shell-and-tube heat exchanger with rod baffle supports and a method of retrofitting an existing shell-and-tube heat exchanger with a rod baffle support is provided. The rod baffle rings comprise a first semi-circular member and a second semi-circular member with a first semi-circular member hinged to the second semi-circular member such that they can be hinged open to allow installation on the existing tube bundle and hinged closed to provide a completed rod baffle ring around the tube bundle.

8 Claims, 3 Drawing Sheets

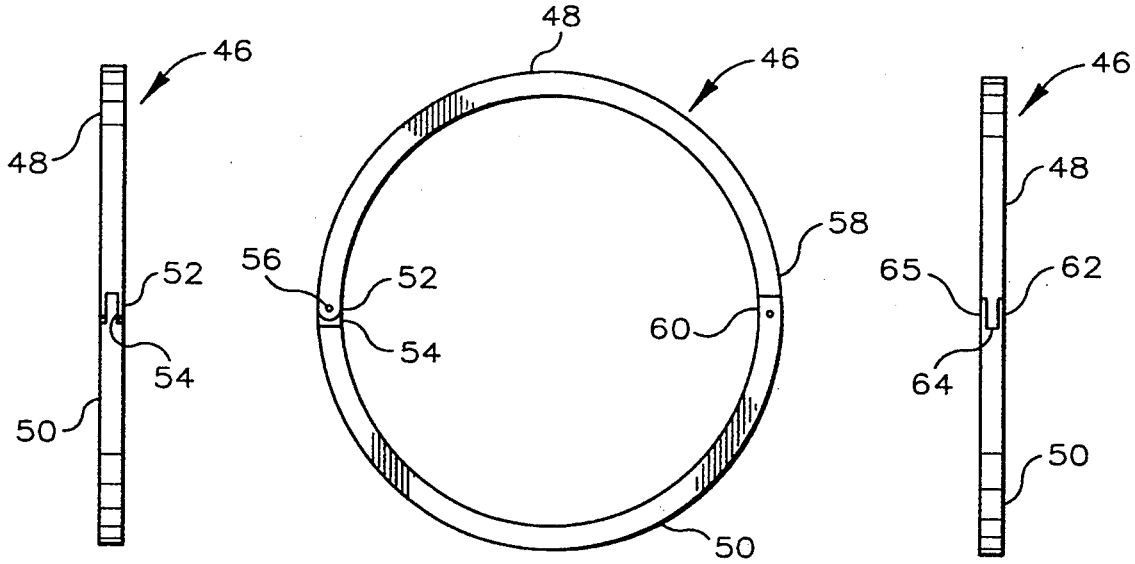
FIG. 5
FIG. 6
FIG. 7
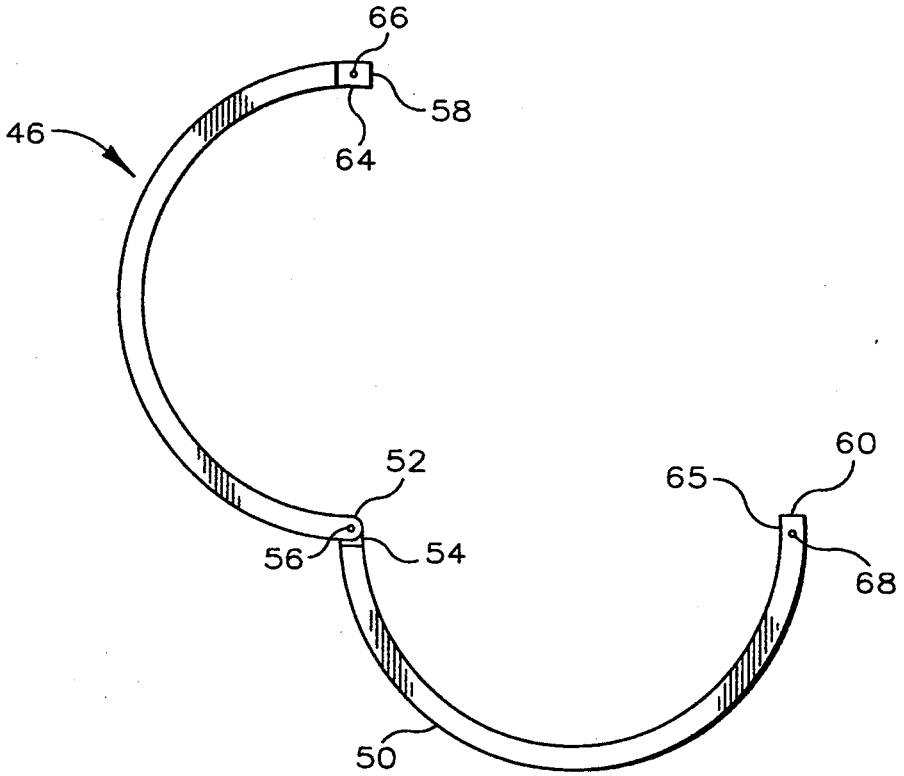
FIG. 8

BAFFLE RINGS FOR RETROFIT OF EXISTING SHELL-AND-TUBE HEAT EXCHANGERS

BACKGROUND OF THE INVENTION

The present invention relates generally to heat exchangers, and more particularly, but not by way of limitation, to shell-and-tube heat exchangers.

Various shell-and-tube heat exchangers have been disclosed in the art. Several of these heat exchangers have been put into successful, practical application. With shell-and-tube heat exchangers, and more particularly with large shell-and-tube heat exchangers, it may be necessary to provide support for the tubes to prevent sagging of the tubes and to prevent damage due to vibrational build-up in the tubes during operation. Rod baffles may be added to the shell-and-tube heat exchanger during manufacturing to provide support for the heat exchange tubes; however, fitting already existing heat exchangers with rod baffles is difficult due to having to tear apart the tube bundle in order to add in rod baffles. It, therefore, would be useful to have a rod baffle that could be easily retrofitted onto existing shell-and-tube heat exchangers.

SUMMARY OF THE INVENTION

It is one object of this invention to provide a rod baffle useful for retrofitting existing shell-and-tube heat exchangers without having to dismantle the tube bundle.

Another object of this invention is to provide a method for retrofitting heat exchangers which does not require the dismantling of the tube bundle.

In accordance with this invention, there is provided an improved baffle ring for use as a supporting apparatus in the tube bundle of a shell-and-tube heat exchanger comprising: a first semi-circular member having a first end and a second end; a second semi-circular member having a first end and a second end; and a hinge means for rotatable securing a first end of the first semi-circular member to the first end of the second semi-circular member in such a manner so as to allow the first semi-circular member to rotate about the first end of the second semi-circular member so that the second end of the first semi-circular member can be positioned in contact with the second end of the second semi-circular member.

In accordance with another aspect of this invention, a process is provided for retrofitting the tube bundle of a heat exchanger with rod baffles which comprises the steps of hinging open the hinged baffle ring described above so that the second end of the first semi-circular member is not in contact with the second end of the second semi-circular member; aligning the baffle ring along the tube bundle; hinging closed the baffle ring so that the second end of the first semi-circular member is position in contact with the second end of the second semi-circular member and such that the rod baffle ring encompasses the tube bundle; fixedly securing the second end of the first semi-circular member to the second end of the second semi-circular member; inserting support rods between the tubes; and fixedly securing the first end and the second end of the support rods to the hinged baffle ring.

BRIEF DESCRIPTION OF THE DRAWINGS

FIG. 5 is an elevation view of the closed baffle ring according to the invention.

FIG. 6 is a side view of the closed baffle ring of FIG. 5 illustrating the hinged means utilized.

FIG. 7 is a side view of the baffle ring illustrated in FIG. 5 showing the fastening means utilized.

FIG. 8 is an elevation view of a baffle ring according to the invention, wherein the baffle ring is hinged open.

DETAILED DESCRIPTION OF THE INVENTION

Figure 1:
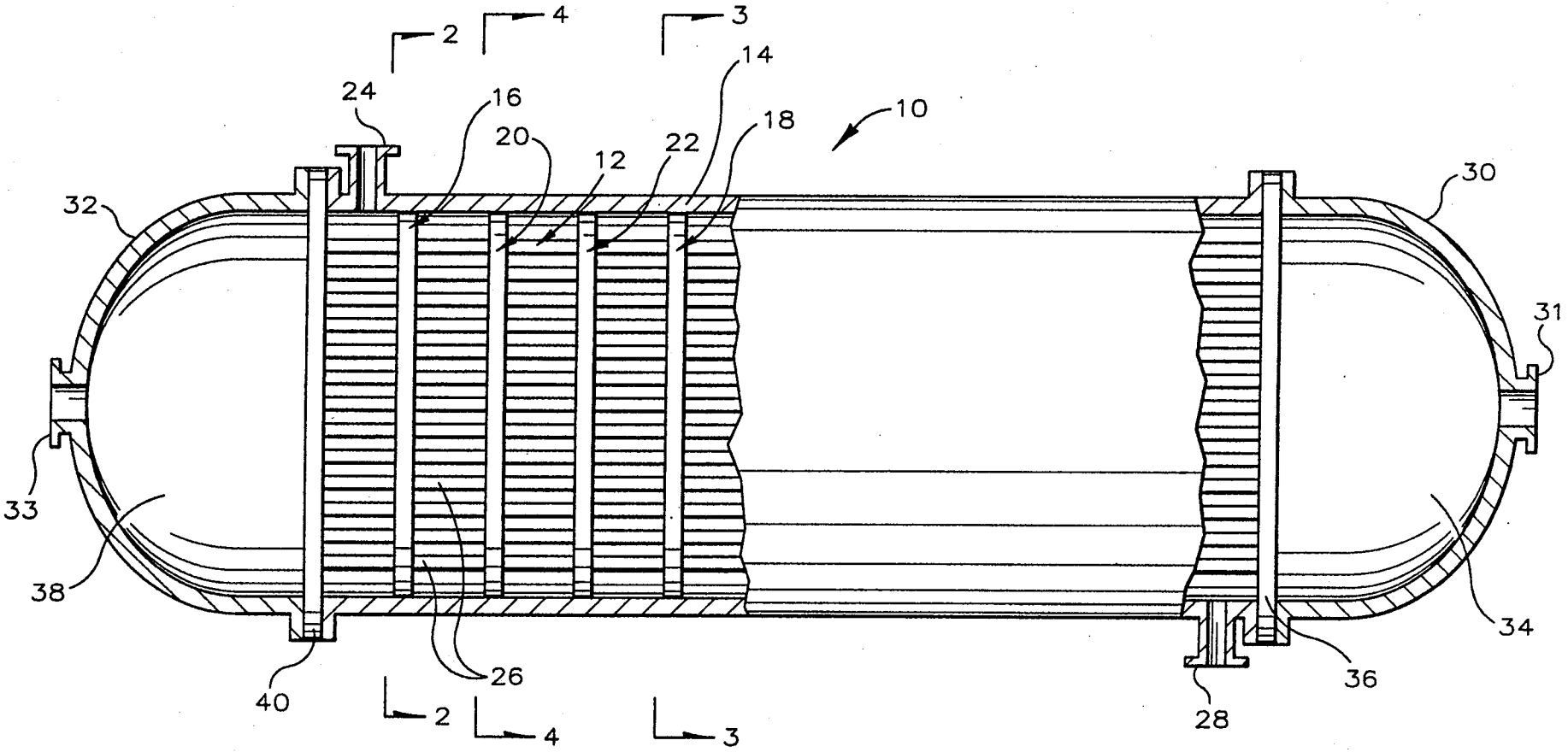
FIG. 1 is a side elevation view of a shell-and-tube heat exchanger utilizing the invention with portions of the shell broken away to more clearly illustrate the internal structure.

Referring now to the drawings, and to FIG. 1 in particular, there is illustrated a shell-and-tube heat exchanger 10. A plate baffle tube bundle 12 is surrounded by shell 14. The plate baffle tube bundle 12 has plate baffle assemblies 16 and 18 and has been retrofitted with horizontal rod baffle assembly 20 and vertical rod baffle assembly 22. The tubes in tube bundle 12 are supported by the rod baffle assemblies 20 and 22.

In operation, one fluid enters the shell side of the shell-and-tube heat exchanger 10 through an inlet 24 and after indirect heat exchange with the fluid in tubes 26, leaves the shell side via outlet 28. During passage through the shell side of the shell-and-tube heat exchanger, the fluid flow is directed by plate baffle assemblies 16 and 18. The fluid flowing through the tube side of the heat exchanger enters the end cap 30 of the heat exchanger via inlet 31 and leaves the end cap 32 of the heat exchanger via outlet 33. This fluid flows from end chamber 34, which is defined by end cap 30 of the heat exchanger and the tube sheet 36, through tubes 26 and into the opposite end chamber 38 which is similarly defined by the end cap 32 and the other tube sheet 40.

Figure 2:
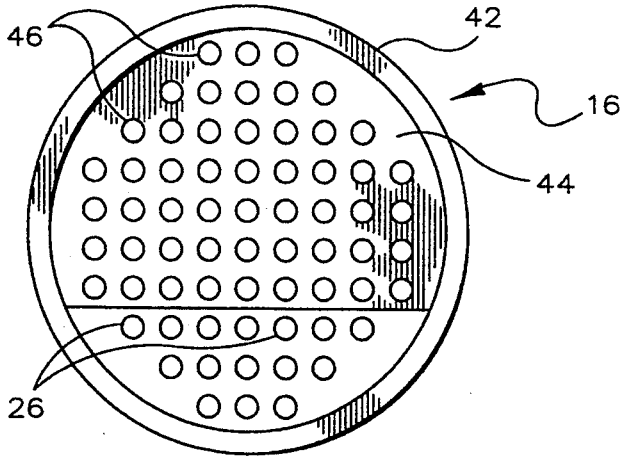
FIG. 2 is a cross-sectional view taken along line 2—2 of FIG. 1.
Figure 3:
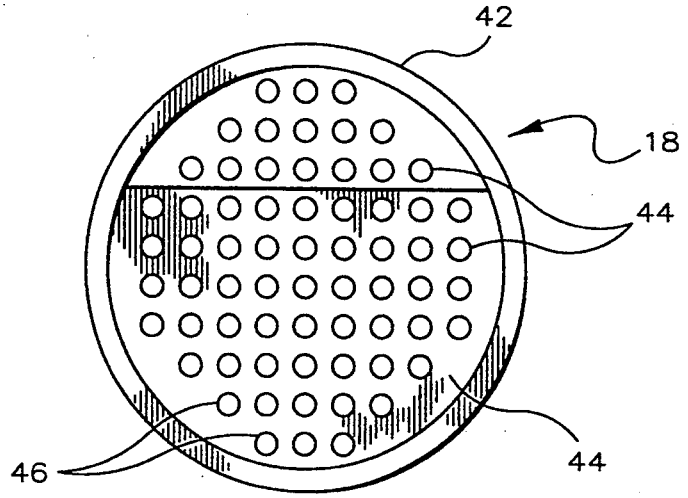
FIG. 3 is a cross-sectional view taken along line 3—3 of FIG. 1.
Figure 4:
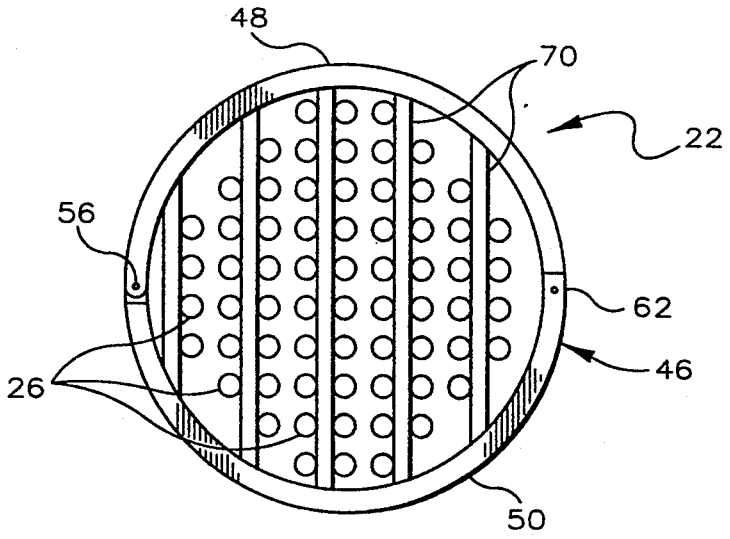
FIG. 4 is a cross-sectional view taken along line 4—4 of FIG. 1.

The tubes 26 can be arranged in a square pattern as shown in FIGS. 2–4. The tubes 26 are kept in position by a plurality of horizontal rod baffle assemblies 20 and vertical rod baffle assemblies 22, which have been retrofitted to the existing plate baffle tube bundle 12. The vertical baffle assembly 22, shown in FIG. 4, is part of a four baffle set, such as the one described in U.S. Pat. No. 5,139,084, the disclosure of which is hereby incorporated by reference. A four baffle set is a baffle set which comprises two horizontal rod baffles and two vertical rod baffles so that the four baffles together provide radial support on four sides of each tube 26.

While the four baffle set is presently preferred, it is emphasized that a supporting apparatus in accordance with the present invention only requires that the rod in each baffle assembly inserted in the spaces between adjacent tube rows, in one plurality of tube rows, are inserted into less than the total number of such spaces. It is immaterial whether the rods are inserted in adjacent spaces, alternate spaces, two adjacent spaces followed by skipping two spaces, or any variation desired.

The minimum number of rods in a baffle assembly is the number sufficient for the baffle set to provide radial support for each tube forming the tube bundle. It is preferred that this functional limitation also be used to determine the maximum number of rods in a baffle assembly because the pressure drop across the shell side of a shell-and-tube heat exchanger is the lowest when the least number of rods are used to form the baffle assemblies; however, it is essential to use enough rods in each baffle assembly for the baffle set to provide radial support for each tube. The number of baffle assemblies constituting a baffle set as described above must not be confused with the total number of baffle assemblies used in the tube bundle as this later number can be any number above minimum number required in the baffle set and the total number of baffle assemblies in the tube bundle is otherwise independent of the number of baffle assemblies in a baffle set.

It is apparent that the minimum number of baffle assemblies per baffle set is dependent upon the tube layout. While FIG. 4 shows a square pitched tube layout, other tube layouts are possible in which the minimum number of baffle assemblies in a baffle set may be other than those specifically discussed. With any tube layout, at least two baffle assemblies per baffle set are required to practice the present invention and the specific tube layouts herein discussed are presented for the purpose of illustration and are not intended to limit the broad invention.

Referring now to FIGS. 2 and 3, plate baffles suitable for use in a plate baffle tube bundle are illustrated. Plate baffles 16, illustrated in FIG. 2, has baffle ring 42 which surrounds tubes 26. Segmental baffle plate 44 has a plurality of apertures 45 therethrough for the passage of a portion of the tubes 26. The apertures 45 are only slightly larger than the diameter of the tubes 26 and functions to partially support the tubes as well as force the fluid which flows from inlet nozzle 24 to outlet nozzle 28 to follow a torturous path and sweep across tubes 26. FIG. 2 has segmental baffle plate 44 in the upper portion of plate baffle assembly 16. FIG. 3 illustrates a similar plate baffle assembly 18 which has segmental baffle plate 44 in the lower portion of the plate baffle assembly 18. Normally, plate baffle assemblies 16 and 18 will be alternated to provide a torturous path for the shell side fluid. Typically, each alternating segmental plate baffle effectively blocks between 60% and 80% of the area of the fluid flow passages defined between the parallel tube row.

Referring now to FIG. 4, a rod baffle assembly 22, according to the invention, is illustrated. Rod baffle assembly 22 comprises baffle ring 46 which has a first semi-circular member 48 and a second semi-circular member 50.

Baffle ring 46 can better be seen in FIGS. 5–8. First semi-circular member 48 is connected at a first end 52 with a first end 54 of second semi-circular member 50 by a hinge means 56. The hinge 56 connects the two semi-circular members so that they are rotatably secured to each other in such a manner as to allow the first semi-circular member 48 to rotate about the first end 54 of the second semi-circular member 50 so that the baffle ring 46 can be either hinged closed or hinged open. In the hinged closed position, as illustrated in FIG. 5, the second end 58 of the first semi-circular member 48 and the second end 60 of the second semi-circular member 50 are positioned in contact and the two members form a closed ring. In the hinged open position, as illustrated in FIG. 8, the second end 58 and the second end 60 are not in contact. Second end 58 and second end 60 can be provided with a fastening means such as mortice joint 62 which has male member 64 and female member 65. Second ends 58 and 60 which form mortice joint 62 have perforations 66 and 68, respectively. When the baffle ring 46 is hinged closed, perforations 66 and 68 are aligned such that the members can be fixedly secured closed by means of a dowel or pin. Additionally, in place of the mortice joint and dowel or other fastening means, or in combination with such a fastening means, the second ends 58 and 60 can be welded closed after baffle ring 46 is positioned around tube bundle 12. Also, after the baffle ring 46 has been positioned around the tube bundle 12 and hinged closed, first ends 52 and 54 can be welded at hinged means 56 if desired.

Returning to FIG. 4, a baffle ring 48 which has been positioned around the tube bundle 12 can be seen. Baffle ring 48 has been fixedly secured in the hinged closed position and surrounds tubes 26. Rod baffle assembly 22 further comprises a plurality of vertically extending support rods 70 that are fixedly secured at their opposite ends to baffle ring 46 and are evenly spaced so that they extend between alternating pairs of the vertical, parallel rows of tubes 26. Optionally, at least one cross support rod extending perpendicular to support rods 70 and fixedly secured to baffle ring 48 at its opposite ends can also comprise rod baffle assembly 22.

To retrofit an existing shell-and-tube heat exchanger, the tube bundle 12 is removed from shell 14. In removing the tube bundle 12 from shell 14, it may be necessary to remove end caps 30 and 32 and one of the tube sheets 36 and 40. The rod baffle rings are then hinged open to permit installation over any remaining tube sheets and the existing plate baffles. The rod baffle rings are aligned along the tube shells in the appropriate places to aid in supporting the tube bundle 12. Once each rod baffle ring is in the correct location and orientation, the two semi-circular members 48 and 50 are hinged closed and secured such as by using a dowel fastener in a mortice joint. Next, the rod baffle ring can be further fixedly secured at the first and second ends of each member by welding at the hinged joint where the first end 52 of the first semi-circular member 48 meets the first end 54 at the second semi-circular member 50 and at the contact point where the second end 58 of the first semi-circular member 48 meets the second end 60 of the second semi-circular member 50. After the rod baffle ring is in place and fixedly secured around the tube bundle, the support rods and any cross support rods may be inserted between the tubes and fixedly secured, such as by welding, at each of their ends to the baffle ring. At this point the tubes 26 are supported by the support rods 70 of the rod baffle assemblies.

The tube bundle 12 thus retrofitted with rod baffle assemblies 20 and 22 can be reinserted into shell 14 and properly positioned therein. Next, the tube sheets can be re-attached, if any were removed, with each end of each tube forming a fluid tight seal with the corresponding aperture in the tube sheet. Finally, the open ends of shell 14 can be closed by re-attaching end caps 30 and 32.

Reasonable variations and modifications which will be apparent to those skilled in the art can be made in this invention without parting from the spirit and scope thereof.

That which is claimed is:

1. An improved rod baffle for use as a supporting apparatus in the tube bundle of a shell-and-tube heat exchanger comprising:

an improved baffle ring comprising a first semi-circular member having a first end and a second end; a second semi-circular member having a first end and a second end; hinge means having an axis of rotation perpendicular to the plane in which said baffle ring lies for rotatably securing said first end of said first semi-circular member to said first end of said second semi-circular member wherein said first end of said first semi-circular member is secured to said first end of said second semi-circular member by said hinge means in such a manner so as to allow said first semi-circular member to rotate about said first end of said second semi-circular member so that said second end of said first semi-circular member can be positioned in contact with said second end of said second semi-circular member; and a plurality of support rods supported by said baffle ring with each support rod in parallel equally spaced relation to the other support rods.

2. The improved rod baffle of claim 1, further comprising a fastening means for securing said second end of said first semi-circular member to said second end of said second semi-circular member.

3. A tube bundle for a shell-and-tube heat exchanger comprising:

a plurality of parallel tubes with a common axis of alignment arranged to form a plurality of parallel rows of tubes;

at least one plate baffle having a plurality of apertures wherein each of said plate baffles is in perpendicular relation to said common axis of alignment of said parallel tubes and a portion of said tubes extends through said apertures; and at least one rod baffle comprising a baffle ring having a first semi-circular member having a first end and a second end, a second semi-circular member having a first end and second end, and hinge means having an axis of rotation perpendicular to the plane in which said baffle ring lies for rotatably securing said first end of said first semi-circular member to said first end of said second semi-circular member wherein said first end of said first semi-circular member is secured to said first end of said second semi-circular member by said hinge means in such a manner so as to allow said first semi-circular member to rotate about said first end of said second semi-circular member so that said second end of said first semi-circular member can be positioned in contact with said second end of said second semi-circular member; and a plurality of support rods, wherein said baffle ring encompasses said plurality of tubes and supports said support rods with each support rod in parallel, equally spaced relation to the other support rods such that said support rods provide support to said plurality of tubes.

4. The tube bundle of claim 3, further comprising a fastening means for securing said second end of said first semi-circular member to said second end of said second semi-circular member.

5. A method for retrofitting a tube bundle, comprised of at least first and second apertured tube sheets, a plurality of parallel tubes each having a first end and a second end and at least one plate baffle, with at least one rod baffle support comprised of a plurality of support rods having a first end and a second end and a baffle ring having a first semi-circular member having a first end and a second end, a second semi-circular member having a first end and second end; and hinge means for rotatably securing said first end of said first semi-circular member to said first end of said second semi-circular member wherein said first end of said first semi-circular member is secured to said first end of said second semi-circular member by said hinge means in such a manner so as to allow said first semi-circular member to rotate about said first end of said second semi-circular member so that said second end of said first semi-circular member can be positioned in contact with said second end of said second semi-circular member, comprising the steps of:

(a) rotating said first semi-circular member about said first end of said second semi-circular member so that said second end of said first semi-circular member is not in contact with said second end of said second semi-circular member;

(b) aligning said baffle ring along said tube bundle;

(c) rotating said first semi-circular member about said first end of said second semi-circular member so that said second end of said first semi-circular member is positioned in contact with said second end of said second semi-circular member and such that said rod baffle ring encompasses said tube bundle;

(d) fixedly securing said second end of said first semi-circular member to said second end of said second semi-circular member;

(e) inserting said support rods between said tubes; and (f) fixedly securing said first end and said second end of said support rods to said baffle ring.

6. A method according to claim 5 wherein said support rods are inserted in step (e) so that each tube is positioned proximate one of said support rods and said support rods provide radial support for said tubes.

7. A method according to claim 6 wherein said rod baffle ring further comprises a fastening means for securing said second end of said first semi-circular member to said second end of said second semi-circular member and wherein in step (d) said second end of said first semi-circular member and said second end of said second semi-circular member is fixedly secured by means of said fastening means.

8. A method according to claim 7 wherein after step (d) said first end of said first semi-circular member is welded to said first end of said second semi-circular member and said second end of said first semi-circular member is welded to said second end of said second semi-circular member.

* * * * *